US006609958B2

(12) United States Patent
Robinson et al.

(10) Patent No.: US 6,609,958 B2
(45) Date of Patent: Aug. 26, 2003

(54) APPARATUS AND METHOD FOR EDGING A CONTACT LENS

(75) Inventors: Douglas P. Robinson, Farmington, NY (US); Craig A. Barrile-Josephson, Rochester, NY (US); Alvah B. Aldrich, Rochester, NY (US)

(73) Assignee: Bausch & Lomb Incorporated, Rochester, NY (US)

( * ) Notice: Subject to any disclaimer, the term of this patent is extended or adjusted under 35 U.S.C. 154(b) by 0 days.

(21) Appl. No.: 09/746,852

(22) Filed: Dec. 21, 2000

(65) Prior Publication Data

US 2002/0115389 A1 Aug. 22, 2002

(51) Int. Cl.[7] ..... B24B 9/00
(52) U.S. Cl. ..... 451/59; 451/173; 451/43
(58) Field of Search ..... 451/43, 42, 255, 451/256, 59, 168, 169, 173

(56) References Cited

U.S. PATENT DOCUMENTS

| | | | | | |
|---|---|---|---|---|---|
| 1,089,456 | A | * | 3/1914 | Beam | 451/42 |
| 3,050,909 | A | | 8/1962 | Rawstron | 51/124 |
| 3,145,506 | A | * | 8/1964 | Vegors et al. | 451/121 |
| 3,423,886 | A | * | 1/1969 | Schpak et al. | 451/43 |
| 3,514,908 | A | * | 6/1970 | Herbert et al. | 451/43 |
| 3,736,115 | A | * | 5/1973 | Blum | 451/42 |
| 3,971,163 | A | | 7/1976 | Trombley | 51/62 |
| 4,054,010 | A | | 10/1977 | Shipman | 51/55 |
| 4,458,454 | A | | 7/1984 | Barnett | 51/284 R |
| 4,656,790 | A | | 4/1987 | Mukai | 51/141 |
| 4,979,337 | A | | 12/1990 | Duppstadt | 51/209 R |
| 5,727,989 | A | | 3/1998 | Ohno | 451/41 |
| 5,868,857 | A | | 2/1999 | Moinpour | 134/6 |
| 5,928,066 | A | * | 7/1999 | Hasegawa et al. | 451/173 |
| 5,957,637 | A | | 9/1999 | Savoie | 409/132 |
| 6,102,777 | A | | 8/2000 | Duescher | 451/36 |

FOREIGN PATENT DOCUMENTS

| | | | | |
|---|---|---|---|---|
| JP | 402237754 | * | 9/1990 | 451/256 |

* cited by examiner

*Primary Examiner*—Robert A. Rose
(74) *Attorney, Agent, or Firm*—Katherine McGuire

(57) ABSTRACT

Apparatus and method for edging an ophthalmic lens comprises a spindle on which a lens is removably positioned and set rotating to engage with a web of abrasive material which is secured at only one end thereof. The free end of the web is allowed to dangle and is also preferably set into an oscillating, vertical movement which edges both the anterior and posterior surfaces of the lens adjacent the lens periphery to thereby smooth the periphery of the lens.

17 Claims, 8 Drawing Sheets

APPARATUS AND METHOD FOR EDGING A CONTACT LENS

BACKGROUND OF THE INVENTION

This invention relates to edging of ophthalmic lenses, and more particularly relates to an improved apparatus and method for edging contact lenses.

It is known in the manufacture of contact lenses that an edging process is many times required to be performed on the contact lens prior to delivery to the consumer. This is due to the various contact lens manufacturing processes which can cause the contact lens to have a thick and/or an irregular peripheral edge profile following the initial making of the lens. Some common contact lens manufacturing techniques include spin casting, lathing, and static cast molding. Edging of the irregular peripheral lens edge is often necessary to smooth and thin the lens edge so that it will glide easily over the eye when placed thereon and not cause irritation or discomfort for the wearer of the lens. Since it is usually necessary to edge every lens in the manufacturing line, the robustness and efficiency of the edging process is of utmost importance so that the lens edging process cost is minimized as much as possible without sacrificing lens quality. Thus, the time it takes to edge a single lens (the lens edging cycle time) is a critical parameter affecting production costs. Polishing of the concave (posterior) and convex (anterior) surfaces of the lens is also sometimes necessary to remove surface defects. While the invention herein is primarily directed to edging of the lens periphery which lies radially outwardly of the optical zone of the lens, it is noted that it may be useful for performing lens polishing as well.

Other common problems and concerns involved in lens edging include, but are not limited to, the following:

1) the transfer of abrasive particles to the lens during edging which can harm the lens and also need to be subsequently removed from the lens, thereby increasing production time;
2) successive wear of the abrasive component over a series of lenses inevitably causing edging variability between the group of lenses edged with a particular abrasive component;
3) the wearing down of individual abrasive components which requires intermittent removal and replacement of worn abrasive components with new abrasive components, a task which results in increased production time;
4) constraints of prior art edging apparatus which do not allow both surfaces of the lens (anterior and posterior) to be edged at the same time; and
5) edging apparatus which are at least in part operator dependent, e.g., apparatus which require an operator to place the lens on a lens holder with the lens substantially centered on the lens holder, thereby causing inevitable variation between lenses due to an operator's inherent inability to consistently center lenses on the lens holder.

Examples of some prior art contact lens polishing and edging techniques may be seen in the following patents:

U.S. Pat. No. 4,979,337 issued to Duppstadt on Dec. 25, 1990

U.S. Pat. No. 3,971,163 issued to Dow Corning Corp. on Jul. 27, 1976

U.S. Pat. No. 3,050,909 issued to Rawstron on Aug. 28, 1962

In the '377 patent, a polishing tool is disclosed which comprises a convex, resilient polishing head covered by a polishing cloth where the head is attached to a rotatable spindle. While the head is set rotating, the polishing head and cloth are engaged with the anterior surface of a lens to thereby polish this surface of the lens. In an alternate embodiment seen in FIGS. 6–9 thereof, a circular recess is provided inwardly adjacent the periphery of the head which provides a configuration adapted to polish and smooth the lens edge in the manner seen in FIG. 8 thereof and discussed at Col. 4, lns. 37–54 and Col. 5, lns. 45–54. It will be readily appreciated that this method of lens polishing does not address many of the concerns listed above with regards to effective lens edging. In a first aspect, it is highly dependent on operator skill in that there are no mechanical control means discussed which would assist in consistent engagement of the polishing tool with the lens. It is also not disclosed how the lens is located during polishing. Furthermore, the polishing cloth will wear over time and cause variability in lens polishing due to this wearing. The cloth will also require intermittent replacement, thereby increasing production time.

In the '909 patent, an apparatus for polishing a lens surface is disclosed which, like the head configuration of the '377 patent, is intended to cover substantially the entire lens surface during the polishing operation. A flexible polishing sheet P is secured in an airtight manner to a fitting Q fixed to a rotatable shaft C where fitting Q defines an air chamber $P_1$ capable of drawing a vacuum to draw sheet P inwardly and form a concave polishing surface for polishing a convex surface. Conversely, the air chamber may be pressurized to cause sheet P to bellow outwardly and form a convex polishing surface when polishing a concave surface. Polishing is effectuated by rocking one or both of the work piece holder and/or the polishing sheet holder relative to the other. See, for example, Col. 5, ln. 9–Col. 6, ln. 13. The apparatus of the '377 patent is directed solely to the polishing of the surfaces of a lens, and there is no discussion as to how one would polish or edge the periphery of a lens. The problem of lens variability due to wearing of the polishing sheet is also not recognized or addressed in this apparatus.

In the '163 patent, an apparatus is disclosed for finishing a lens using an abrasive, flexible tape which is wound through a series of rollers from a tape feed reel to a tape take-up reel. The lens is held in a collet and brought into engagement with the web which is travelling from the feed reel to the take-up reel at a predetermined rate of speed (Col. 5, lns. 5–10). The web is held between a pair of guide rollers 44A and 44B and kept in tension by a spring clutch 60 (Col. 4., lns. 24–31). The purpose of the finishing operation according to the disclosure is to remove the "bevatic bump" which is formed during a previous lens grinding operation which itself is not described (see Col. 1, lns. 59–end). The manner in which the lens is finished by this invention is not clearly demonstrated, although it states at Col. 2, lines 7–10 that " . . . the grinding surface will substantially conform to the surface to be ground thereby increasing the possibility that the total surface will be finished without skipping any area." (emphasis added). The angularity of the tape is said to be adjustable with respect to the lens, although it is clear that the vertical orientation of the tape with respect to the lens as seen in FIG. 4 would not change since plate 66 can only pivot and move in the plane in which plate 66 lies. Plate 66 may be set oscillating as well within this same plane (see Col. 3, lns. 60–end and Col. 6, lns. 5–15). While this technique may be sufficient to remove the so-called bevatic bump from a lens, it does not appear to be able to edge a lens periphery in the same manner as contemplated by the present invention as set out more fully below.

In another known prior edging technique, a circular foam pad is set rotating and a lens set rotating on a spindle is engaged therewith to edge the lens. The lens may be passed back and forth across the radius of the pad while both the pad and lens are rotating. This technique suffers from all the disadvantages of the prior art mentioned above.

There therefore remains a need for a lens edging device and method which is able to smooth an irregular lens periphery and which solves the problems of the prior art edging devices described above.

SUMMARY OF THE INVENTION

The present invention provides a lens edging device and method which solves the problems of the prior art by providing a loose web of abrasive material against which the peripheral edge of a lens is engaged while the lens is set rotating on a lens holder. More particularly, the loose web of material is fed from a spool and secured at a point near the free end thereof. The free end of the web is allowed to dangle freely at a predetermined angle with respect to the orientation of the lens. The web is furthermore set oscillating along a vertical plane with respect to the lens. In the preferred embodiment, the free end of the web is formed into a loop. During operation, the lens periphery traverses the loop between the secured end of the loop to the free end thereof. The interaction between the loop and lens cause both the anterior and the posterior surfaces of the lens at the lens periphery to be engaged with the web. More particularly, during the initial upstroke of the web, the anterior surface of the lens at the periphery thereof is engaged with the web, and during the last part of the upstroke and the downstroke of the web, the posterior surface of the lens at the periphery is engaged with the web. During the last part of the downstroke and the initial part of the upstroke, the anterior surface of the lens is again engaged with the web, with the web cupping and riding over the lens edge as it travels from the anterior to the posterior surface of the lens edge and back again. This manner of lens edging is extremely effective at edging a lens with near-perfect and consistent results which are not attainable with the prior art methods. The present invention thus provides a lens edging device and method which solves each of the problems with the prior art methods described above.

DETAILED DESCRIPTION

Figure 1:
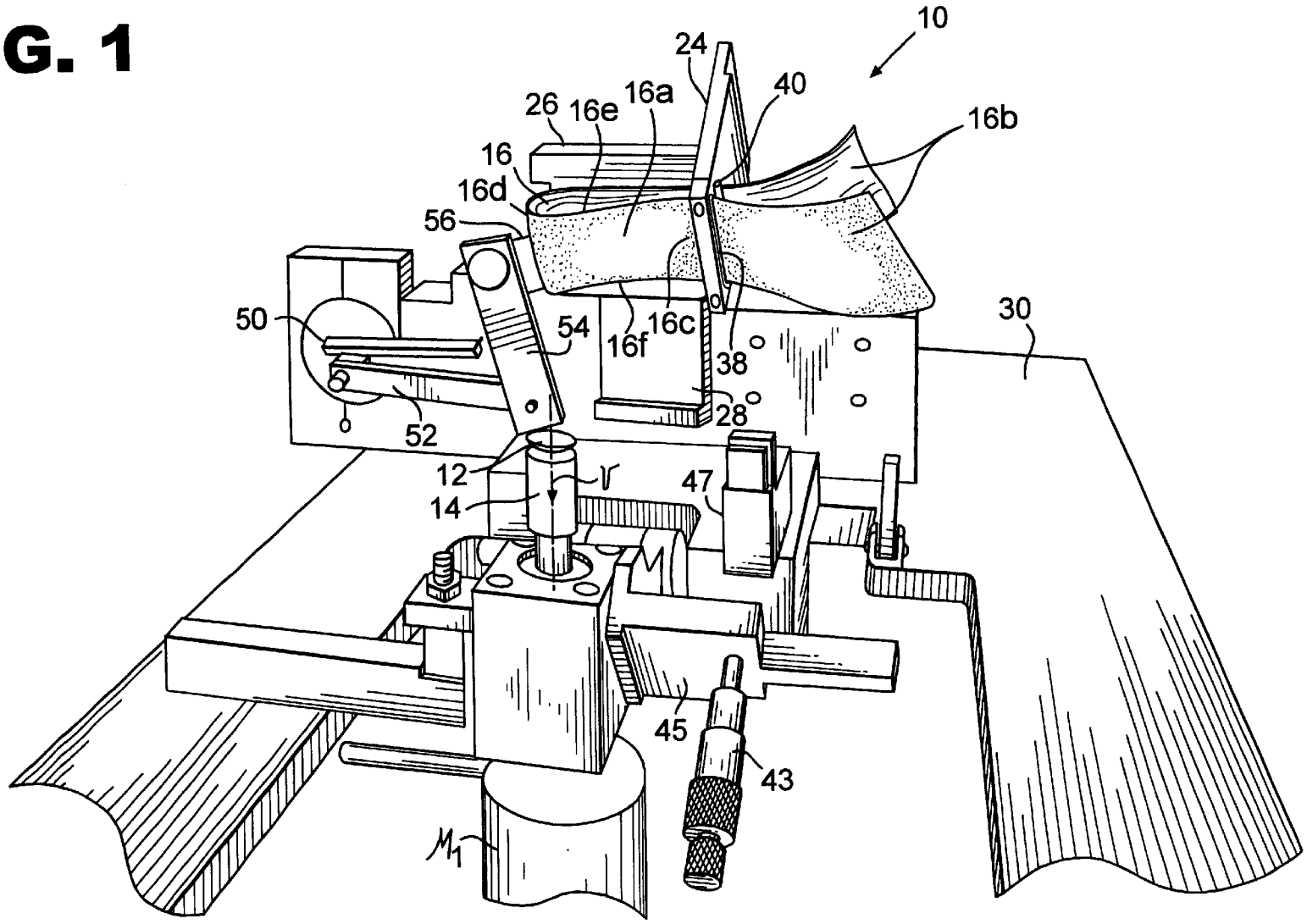
FIG. 1 is a front, perspective view of the apparatus embodying the invention.
Figure 2A:
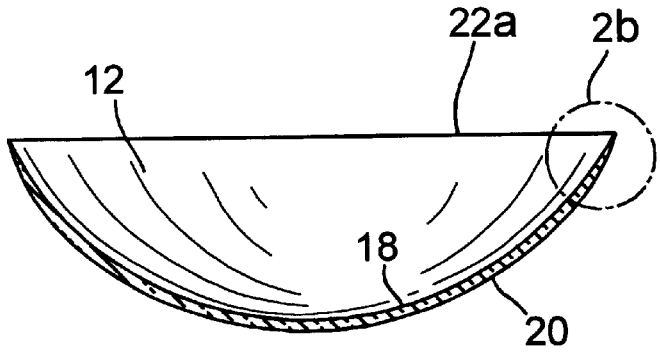
FIG. 2*a* is a cross-sectional view of a contact lens which may be edged with the apparatus of FIG. 1.
Figure 2B:
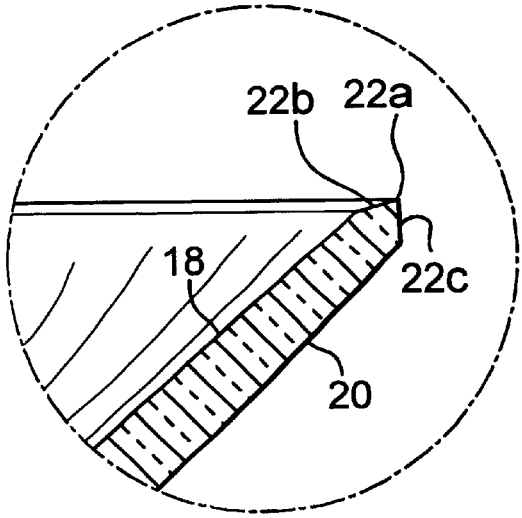
FIG. 2*b* is an enlarged view of the section 2*b* of FIG. 2*a;*
Figure 3:
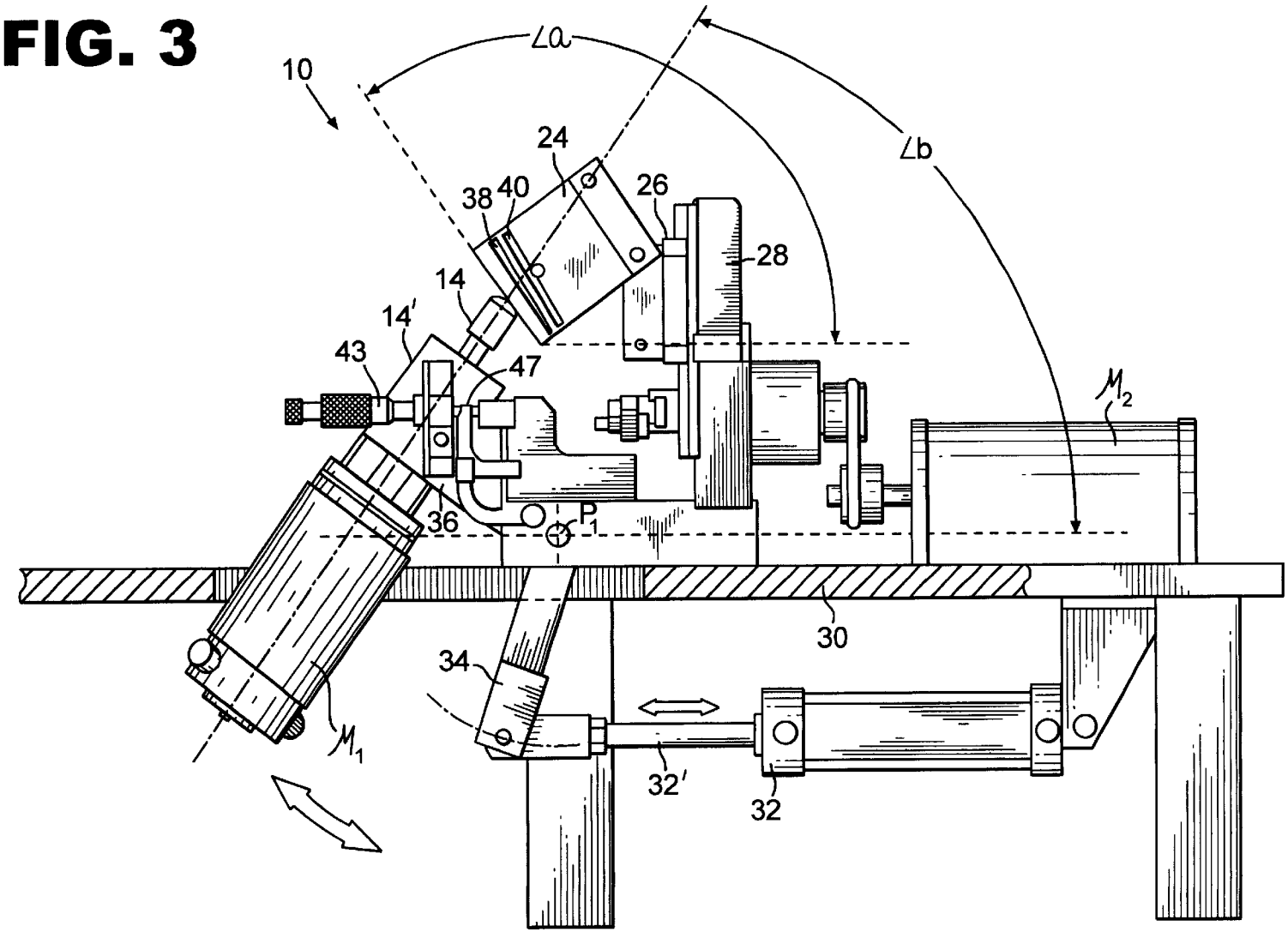
FIG. 3 is a side elevation view of FIG. 1.

Referring to the drawing, there is seen in FIG. 1 an apparatus 10 for edging a contact lens 12 held on a rotatable spindle 14. As seen in FIGS. 1 and 3, spindle 14 is pivotably movable between the vertical position seen in FIG. 1, to the angled position seen in FIG. 3 where contact lens 12 is brought into engagement with an abrasive web of material 16. As discussed above, the edging of a contact lens is many times necessary to smooth irregularities and/or thin the peripheral edge of the lens to improve the on-eye comfort of the lens for the user. An exemplary contact lens 12 is seen in FIGS. 2*a* and 2*b* which has been formed in a cast molding operation between a female mold section and a male mold section which together define a lens-shaped mold cavity wherein a quantity of liquid lens material (monomer) is dispensed and cured (this process is not shown in the drawing). Once cured and removed from the mold, lens 12 is seen to include a concave, posterior surface 18 which is placed directly against the eye, and an opposite convex, anterior surface 20 which faces away from the eye when the contact lens is worn. As seen best in FIG. 2*b*, the periphery of lens 12 is formed with a beveled edge having an edge apex 22*a* defined by anterior bevel surface 22*b* and posterior bevel surface 22*c*. It is primarily these surfaces which are subjected to the edging operation, although the portions of the surfaces 18 and 20 lying closely adjacent surfaces the edge 22*a,b* and *c* may also be engaged with the abrasive web 16 as will be discussed more fully below. It is also noted that the present invention is useful for edging lenses having a variety of edge configurations, and the invention is therefore not limited to the specific lens configuration 12 shown and described herein.

Referring still to FIGS. 1 and 3, edging device 10 is seen to include an abrasive web securing device 24 which is mounted upon a vertical slide mechanism 26 which rides vertically up and down along a track in riser 28. Riser 28 is fixed to a suitable support such as table 30. Web securing device 24 presents a loose end of web material whereupon lens 12 may be brought into engagement therewith by pivoting spindle 14 to the position seen in FIGS. 3 and 5–7. The pivoting movement of spindle 14 is provided by a linear actuator 32 having a retractable shaft 32' which pivotally connects to an arm 34 which pivotally connects at point $P_1$ (see FIG. 3) to a connector 36 which ultimately connects to the spindle 14. In FIG. 3, actuator shaft 32' is in its extended position which causes spindle 14 to pivot to the engaged position seen in FIG. 3. Retracting shaft 32' causes arm 34 to swing toward the actuator 32 about pivot $P_1$, which thereby swings connector 36 to push spindle 14 to the upright position seen in FIG. 1. While in the upright position, lenses may be alternately attached and removed from spindle 14 as needed. It is noted that spindle 14 is preferably a pneumatic device having a motor $M_1$ which draws a vacuum "v" through a central orifice in the spindle to maintain a lens 12 thereon. Release of the vacuum v allows the lens to be released from the spindle 14. It is furthermore noted that perfect centration of lens 12 upon spindle 14 is not necessary to achieve the desired edging results with apparatus 10. As such, the present invention does not rely on consistent lens centering by an operator, a significant drawback to prior art methods as mentioned above. Referring again to FIG. 1, the section of web 16 presented for engagement by the lens 12 is denoted by reference numeral 16*a*, with the non-engaged portion thereof denoted by reference numeral 16*b*. Web section 16*a* is secured only at section end 16*c* thereof, while the opposite section end 16*d* is not secured and thus allowed to dangle and move about. This manner of securing web is very important in how the lens edge engages the web section 16*a*. This will be explained in greater detail later with regard to FIGS. 4*a* and 4*b*.

In the preferred embodiment, the angle of web section 16*a* is set at an angle "a" relative to horizontal (see FIG. 1) of about 100°–145°, and is more preferably about 125°. It is seen that the spindle 14 is also set at an angle "b" relative to horizontal which may be adjusted via threaded pin 43 which is threaded through a hole in plate 45 which itself is fixed to the housing 14' of spindle 14. pin free end 43' abuts vertically oriented plate 47 which is mounted to table surface 30. Turning pin 43 either in the clockwise or counterclockwise direction effectively shortens or lengthens the section of the pin located between the plate 45 and pin free end 43' which, in turn, adjusts the pivotal angle of spindle 14 with respect to web section 16*a* (see FIGS. 1, 3 and 7). In the preferred embodiment, the spindle angle b is set at about 45° to about 55°, and is more preferably about 51°.

Figure 8:
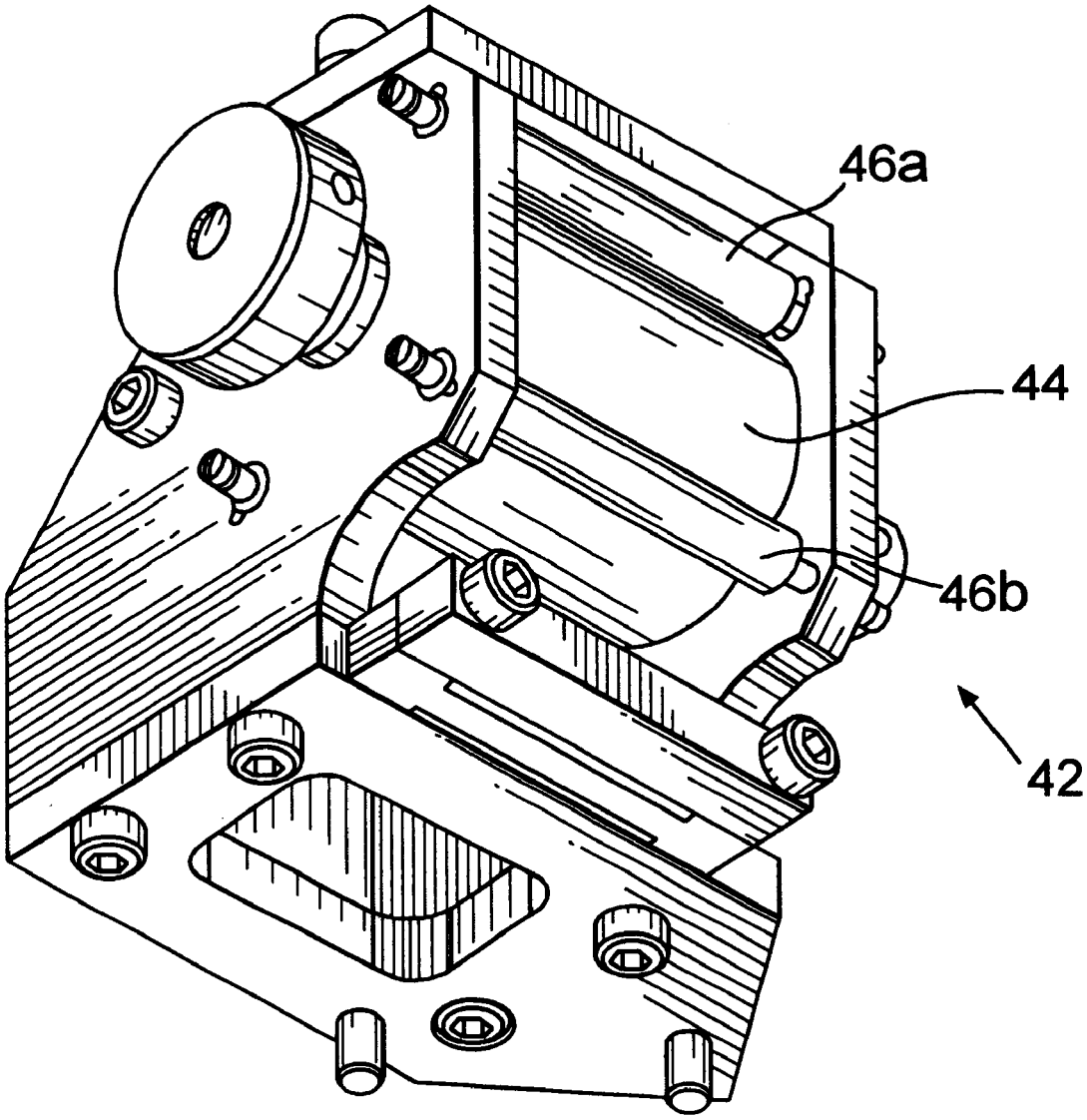
FIG. 8 is a perspective view of an alternate embodiment of the loop securing mechanism.

In the preferred embodiment of the invention, the section 16*a* of the web of abrasive material is formed into a loop as shown in the Figures, although a loop configuration is not absolutely critical. For example, the web section 16*a* may instead terminate at a cut end at 16*d* rather than having the web extend back toward end 16*c* to form a loop. To form a loop, the web of material is fed through a first slot 38 and then fed in the opposite direction back through a second slot 40. In yet a further preferred embodiment of the invention, the web of material is fed from a first spool (not shown) and taken up by a second spool (also not shown), with the web of material being fed through a securing mechanism such as mechanism 42 seen in FIG. 8. Mechanism 42 includes a drive or guide roller 44 and a plurality of pinch rollers 46*a,b* spaced thereabout to control the advancement and indexing of web 16 therethrough. In this regard, it is noted that while it is not necessary for the web to advance through the securing device 24,42 during the lens edging operation, the engagement section 16*a* of the web of material will need to be replaced periodically by a new section of abrasive material, for example, after about every 10–20 lenses. This will, of course, depend on the quality of the abrasive web and the lens material being used. In the preferred embodiment, the web material is a cerium oxide flock coated abrasive film which is manufactured by the 3M Company, St. Paul, Minn. under the trademark 3M Imperial Polishing Film. It has been found that the wearing of this abrasive is so slight with the present invention, that there is no detectable variability in lens edge quality due to the wearing of the abrasive. This is again a significant advantage over the prior art as mentioned above.

As mentioned above, the web securing device 24 is attached to a vertical slide mechanism 26 such that the web section 16*a* oscillates vertically with regard to lens 12 during the lens edging operation. As seen best in FIGS. 3, 6 and 7, vertical oscillation of slide 26 is imparted by a variable speed motor $M_2$ which connects via a belt drive 48 to an eccentric 50 and cranks 52,54, 56 which ultimately connect to slide 26. Other means of imparting vertical oscillation to slide 26 are of course possible and the arrangement shown and described herein is but one of many ways this can be accomplished as understood by those skilled in the art.

While the feature of having the engaged portion of the web 16*a* have a free end 16*d* opposite the secured end 16*c* is considered a key element of the edging operation herein, the addition of vertical oscillation is preferred in order to obtain the best possible edging of lens 12. The combination of the free end 16*d* and the vertical oscillation of the engaged section 16*a* creates the dynamic movement between the lens 12 and the web section 16*a* which smoothly edges both the anterior and posterior surfaces of the lens edge.

Figure 4A:
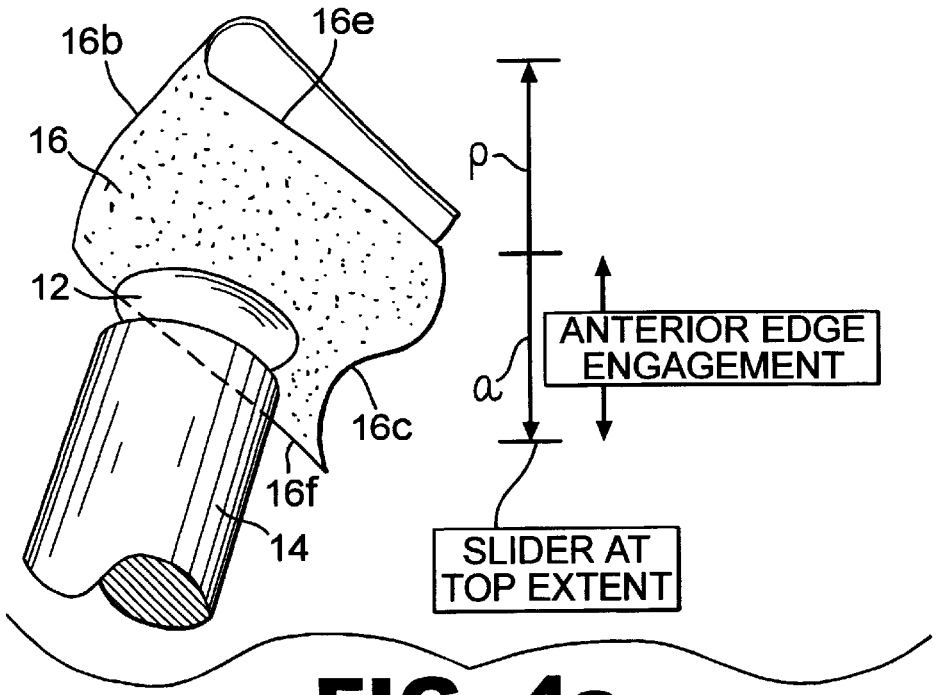
FIG. 4*a* is an enlarged, fragmented, perspective view of a contact lens engaging the abrasive loop in the intended manner with the loop located at the top extent of its travel on the slider mechanism.
Figure 4B:
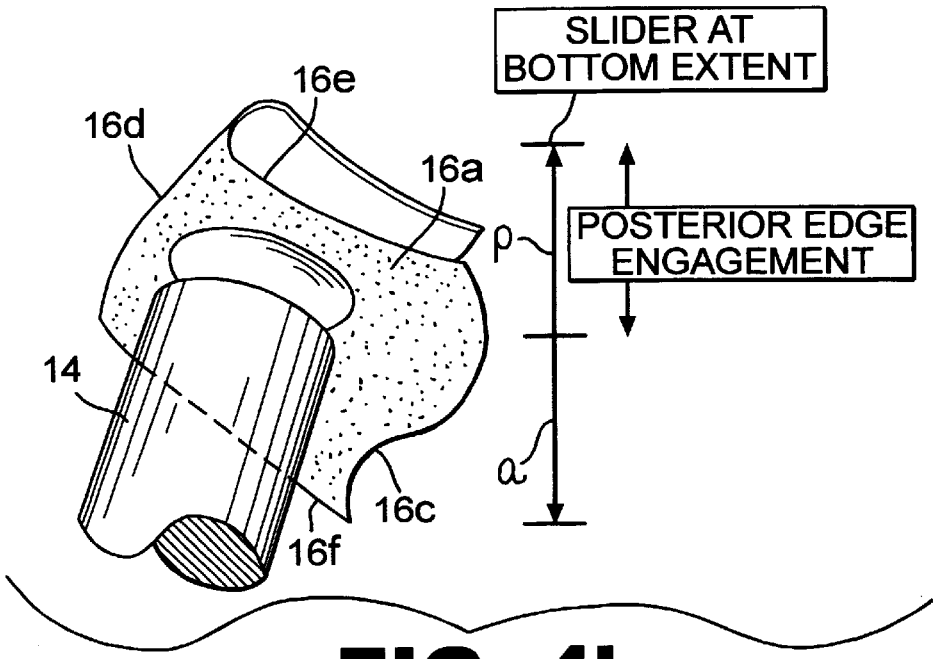
FIG. 4*b* is the view of FIG. 4*a* except with the loop located at the bottom extent of its travel on the slider mechanism.
Figure 5:
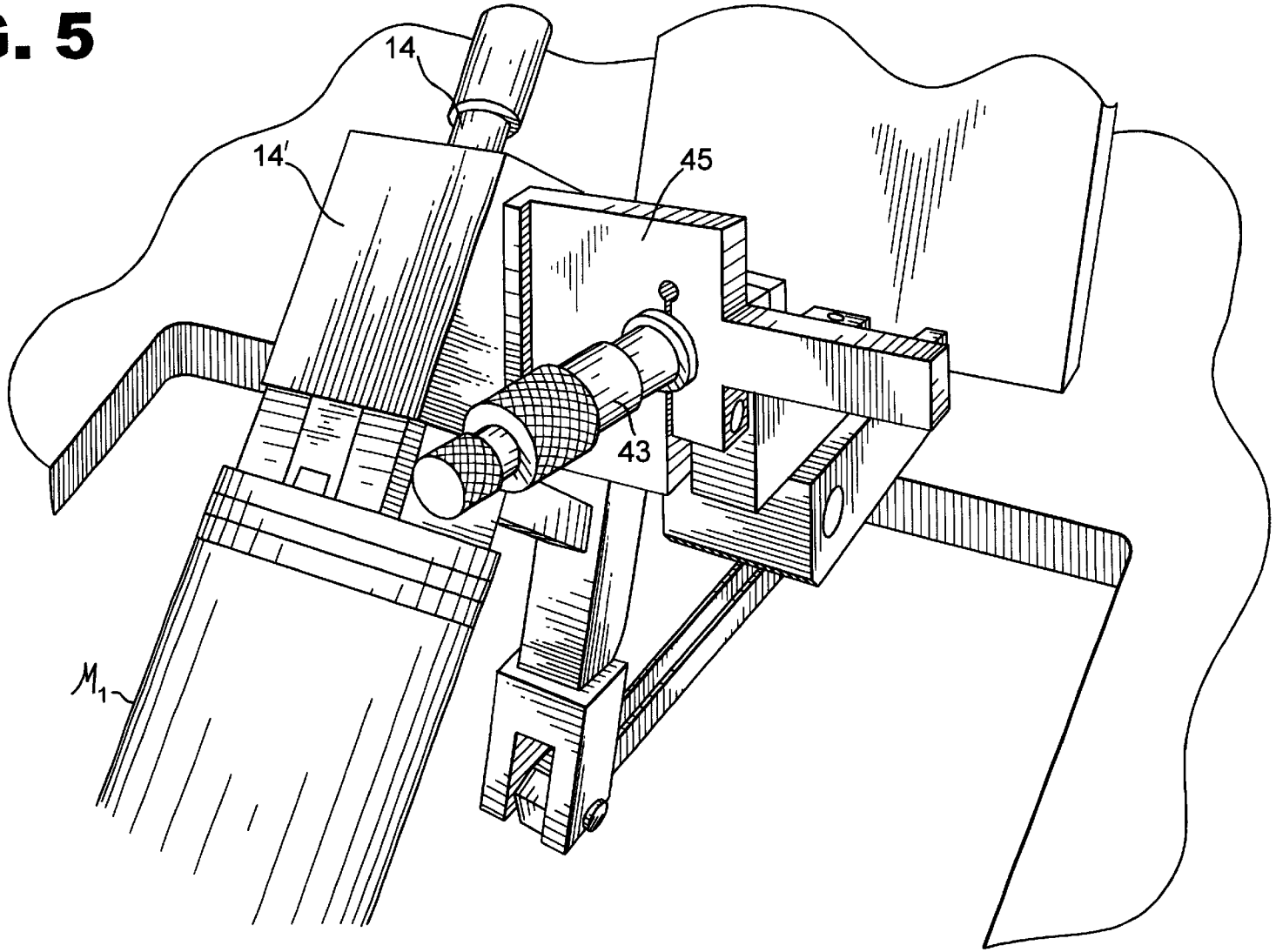
FIG. 5 is an enlarged, fragmented, perspective view of the apparatus of FIG. 1.
Figure 6:
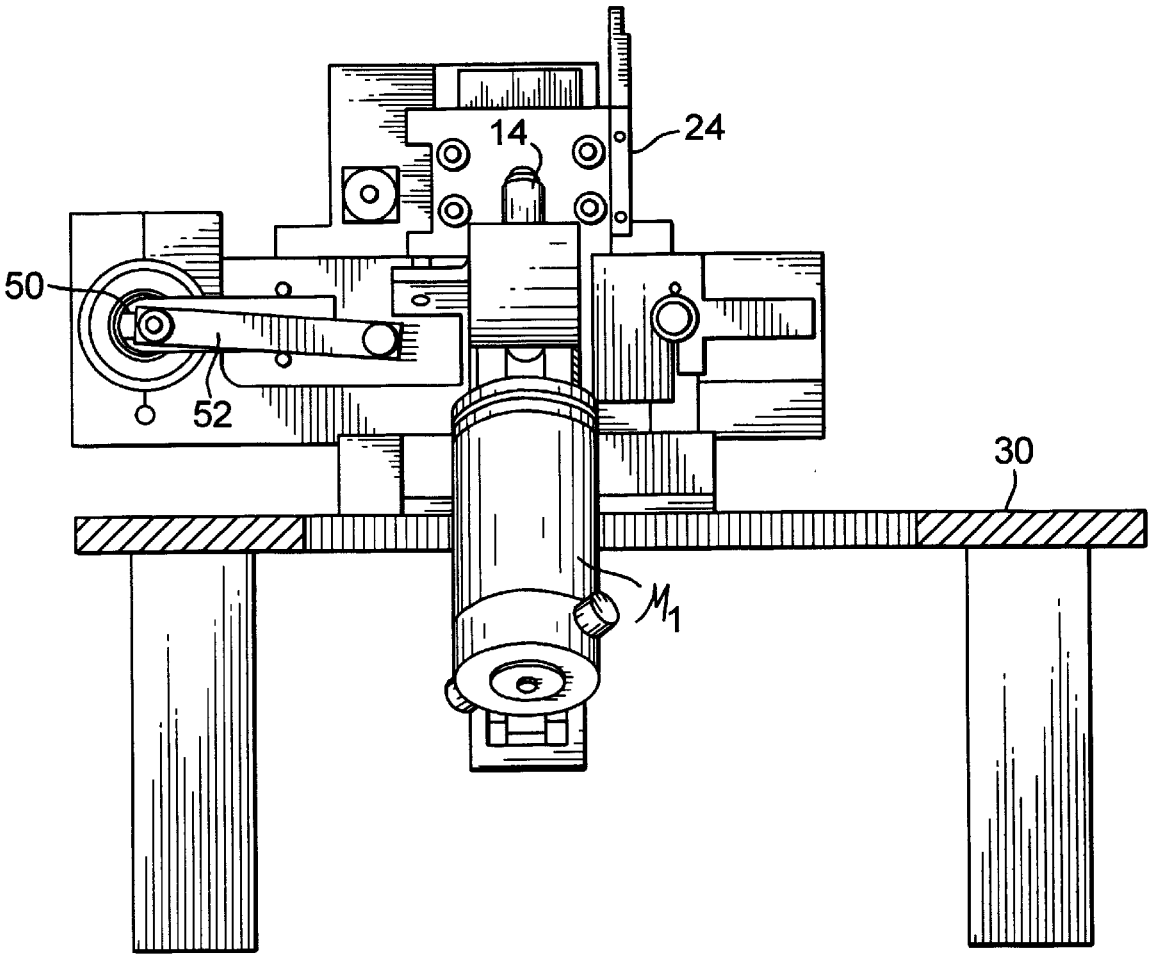
FIG. 6 is a front, elevational view thereof.
Figure 7:
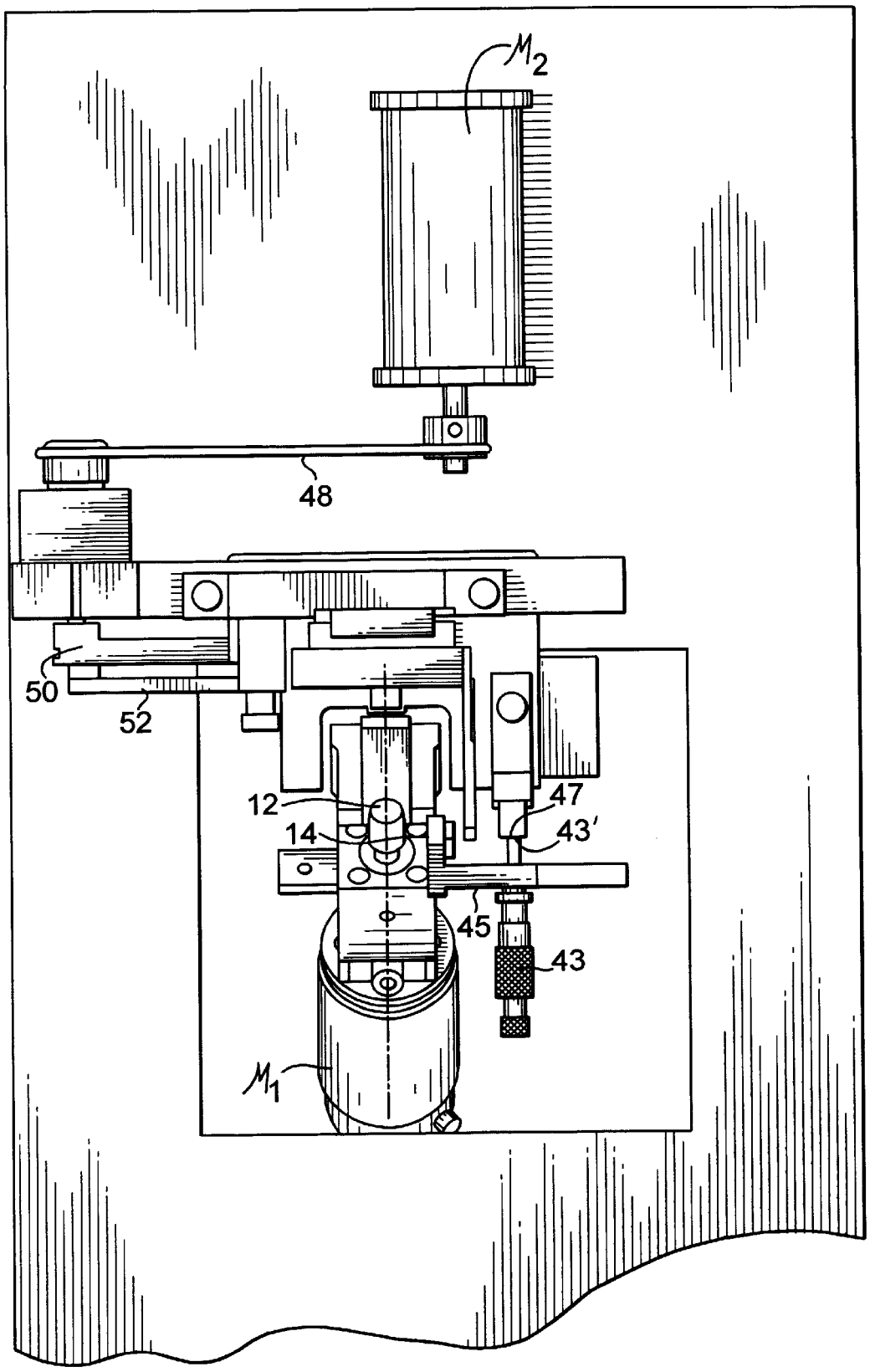
FIG. 7 is a top plan view thereof.

The manner of lens-to-web engagement is more clearly seen with regard to FIGS. 4*a* and 4*b* where in FIG. 4*a*, the slide 26 is at its upper-most extent of travel and the lens edge 22*a* is located closer to web bottom edge 16*f* than to web top edge 16*e*. In FIG. 4*b*, slide 26 is at its lower-most extent of travel and the lens edge 22*a* is closer to web top edge 16*e* than to web bottom edge 16*f*. The arrows to the right of the FIGS. 4*a* and 4*b* represent the width of web material (as measured between web top edge 16*e* and web bottom edge 16*f*) being engaged by the lens 12 during a full stroke of slide 26, and what part of the lens 12 is being engaged by the web according to its position and direction of travel with respect to the web. Thus, referring to the arrow of FIG. 4*a*, lower arrow section "a" represents the fact that when the slide is at its upper-most extent, the lens 12 is located closer to web bottom edge 16*f* and the anterior edge surface 22*c* is engaging the web section and being abraded thereby. As the slide 26 travels downwardly, the lens 12 travels toward web top edge 16*e* represented by arrow section "p" whereupon the web section 16*a* is engaging the posterior edge surface 22*b* of the lens 12, riding over edge apex 22*a* during the transition from the anterior edge surface to the posterior edge surface. Likewise, as slide 26 oscillates back toward its upper-most extent of travel, the posterior edge surface 22*b* is engaged by the web until a mid-way point whereupon the web passes over the lens edge apex 22*a* and engages the anterior edge surface 22*c*. As lens 12 traverses the width of web 16 from top edge 16*e* to bottom edge 16*f*, it is observed that about one quarter of the circumference of lens 12 is sequentially engaged by the web understanding, however, that since lens 12 is rotating on spindle 14 during this time, the entire circumference of the lens is engaged and abraded by the web. This pattern of lens-to-web engagement is repeated through multiple oscillations until the lens edge 22*a,b,c* has been smoothed.

It is noted that the flexibility of the web allows the web to be moved by the forces of the lens 12 acting thereagainst which further contributes to the desired edging effects of the present invention. In particular, it is believed that this flexibility, in combination with one end of the web being unsecured and set into a vertical oscillation, allows the web 16 to traverse the lens edge from the posterior edge surface to the anterior edge surface and back again with the web "cupping" over the edge apex 22*a*. This interactive movement between the web and lens as created by the present invention results in the best lens edging process seen to date.

The following parameters have been found to obtain the best results with the invention, although it is understood that these parameters may need to be adjusted depending on the exact configuration of the invention ultimately employed in a particular manufacturing operation. It is believed that those skilled in the art would be able to adjust the parameters to accommodate their particular manufacturing setting to achieve the benefits of the invention without undue experimentation.

| | |
|---|---|
| Lens spindle speed | About 4000–6000 rpm |
| Web directional changes | About 3.5 full strokes per second |
| Web angle "a" | about 125° |
| Cycle time | About 2 seconds |
| Lens spindle angle "b" | About 51° |
| Lens depth setting on spindle | About 3.4 inches |
| Width of web from top edge to bottom edge | About 1.5 inches |

-continued

| | |
|---|---|
| Length of web from secured end to free end | About 4 inches |
| Web vertical stroke setting | About 1.25 inches |

What is claimed is:

1. Apparatus for edging an ophthalmic lens having an anterior edge portion and a posterior edge portion defining an edge apex, said apparatus comprising:

a) a flexible web of abrasive material having a first, free end and a second, secured end whereby said free end dangles from said secured end;

b) a rotatable spindle on which said lens is removably positioned and rotated during engagement of said lens with said flexible web of abrasive material, said lens edge being directed along the section of said web located between said secured end and said free end thereof whereby said anterior edge portion, said posterior edge portion and said edge apex are each sequentially engaged and abraded by said web section; and c) means for oscillating said web section during engagement of said lens therewith, wherein said oscillation means comprises a vertical slide mechanism which oscillates said web section along a vertical plane.

2. A method for edging the peripheral edge of an ophthalmic lens having an anterior surface and posterior surface, said method comprising the steps of:

a) providing a rotatable spindle upon which said lens may be removably mounted and rotated;

b) providing a web of abrasive material having a first, secured end and an opposite, free end which is allowed to dangle from said secured end;

c) engaging said peripheral edge of said rotating lens against said web between said secured and free ends thereof; and d) oscillating said web during engagement of said lens therewith wherein said oscillation is along a vertical plane which lies generally perpendicular to the length of said web as measured from said secured end to said free end thereof.

3. Apparatus for edging an ophthalmic lens having an anterior edge portion and a posterior edge portion defining an edge apex, said apparatus comprising:

a) a flexible web of abrasive material having a first, free end and a second, secured end whereby said free end dangles from said secured end, wherein said web section is formed into a loop;

b) a rotatable spindle on which said lens is removably positioned and rotated during engagement of said lens with said flexible web of abrasive material, said lens edge being directed along the section of said web located between said secured end and said free end thereof whereby said anterior edge portion, said posterior edge portion and said edge apex are each sequentially engaged and abraded by said web section; and c) means for oscillating said web section during engagement of said lens therewith, wherein said oscillation means comprises a vertical slide mechanism which oscillates said web section along a vertical plane.

4. The method of claim 2 wherein said web has an abrasive surface which faces and is set at a predetermined angle relative to said rotating lens.

5. The apparatus of claim 3 further comprising a component for securing said secured end of said web section, said securing component including first and second slots wherethrough said web section may be passed in opposite directions to form said loop.

6. The apparatus of claim 5 wherein said loop extends from said secured end to said free end thereof in a substantially horizontal plane relative to said vertical plane in which said slide mechanism moves.

7. The apparatus of claim 5 wherein said securing component includes means for selectively advancing said web of material therethrough.

8. The apparatus of claim 7, wherein said advancing means comprises a drive roller and a plurality of pinch rollers spaced about said drive roller between which said web is passed, said pinch rollers being selectively engagable with said drive roller to secure said web with respect thereto.

9. The apparatus of claim 1 wherein said abrasive in said web is comprised of cerium oxide.

10. The apparatus of claim 1 wherein said spindle is pivotally mounted to a support and is selectively movable between an upright, vertical position for removal and attachment of a lens thereto, and an angled position for engaging said lens with said web section.

11. The apparatus of claim 7 wherein said web section is set an angle relative to said lens.

12. The apparatus of claim 7 wherein said pivotal mounting of said spindle is selectively adjustable to change the angle of said spindle pivot.

13. The method of claim 2 wherein said oscillation is along a vertical plane which lies generally perpendicular to the length of said web as measured from said secured end to said free end thereof.

14. The method of claim 2 wherein said web is formed into a loop.

15. The method of claim 14 and further comprising selectively advancing said web loop between lens edging operations to present a new section of said web for engagement with said lens.

16. The method of claim 2 wherein said anterior and posterior surface of said lens located adjacent said lens periphery are alternately engaged by said web during said lens edging.

17. The method of claim 2 wherein said abrasive in said web is comprised of cerium oxide.

* * * * *